US008459437B2

(12) United States Patent
Guan et al.

(10) Patent No.: US 8,459,437 B2
(45) Date of Patent: Jun. 11, 2013

(54) FINANCIAL SELF-HELP SERVICE DEVICE FOR PREVENTING PLUGGING BY FOREIGN OBJECTS AND DAMAGE BY MUCILAGE GLUE

(75) Inventors: Zeyan Guan, Guangzhou (CN); Xiaodian Chen, Guangzhou (CN); Dong Wei, Guangzhou (CN); Nian Wang, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/500,257

(22) PCT Filed: Sep. 21, 2010

(86) PCT No.: PCT/CN2010/077195

§ 371 (c)(1),
(2), (4) Date: Apr. 4, 2012

(87) PCT Pub. No.: WO2011/054239

PCT Pub. Date: May 12, 2011

(65) Prior Publication Data

US 2012/0192770 A1 Aug. 2, 2012

(30) Foreign Application Priority Data

Nov. 6, 2009 (CN) ..... 2009 1 0193708

(51) Int. Cl.
*G07F 1/04* (2006.01)

(52) U.S. Cl.
USPC ..... 194/347; 194/202; 194/348; 194/351; 902/8; 902/17

(58) Field of Classification Search
USPC . 194/200, 202, 347, 348, 351, 350; 902/8–21
See application file for complete search history.

(56) References Cited

U.S. PATENT DOCUMENTS 5,760,380 A 6/1998 May
6,398,108 B1 6/2002 Swinton et al.

(Continued)

FOREIGN PATENT DOCUMENTS

CN 1967604 A 5/2007
CN 1995673 A 7/2007

(Continued)

OTHER PUBLICATIONS

International Search Report dated Dec. 30, 2010 from corresponding International Application No. PCT/CN2010/077195.

(Continued)

*Primary Examiner* — Jeffrey Shapiro
(74) *Attorney, Agent, or Firm* — Wolf, Greenfield & Sacks, P.C.

(57) ABSTRACT

A financial self-help service device for preventing plugging by foreign objects and damage by mucilage glue is provided. It has a panel, and a cash inlet-outlet (1) is set on the panel. The financial self-help service device further includes a gate (2) for opening or closing the cash inlet-outlet (1). POM (polyoxymethylene) plastic convex points (9) are provided at the edge of the gate (2) matched with the cash inlet-outlet (1), so as to form a flow guide gap between the gate (2) and the panel when the gate (2) closes the cash inlet-outlet (I).

4 Claims, 3 Drawing Sheets

U.S. PATENT DOCUMENTS

| | | | | |
|---|---|---|---|---|
| 7,567,088 | B2 | 7/2009 | Yoshida et al. | |
| 2004/0041397 | A1* | 3/2004 | Murphy | 285/197 |
| 2006/0111489 | A1* | 5/2006 | Hase et al. | 524/210 |
| 2006/0200985 | A1* | 9/2006 | Workman et al. | 29/860 |
| 2006/0209589 | A1 | 9/2006 | Smith | |
| 2008/0035446 | A1* | 2/2008 | Yoshida et al. | 194/318 |

FOREIGN PATENT DOCUMENTS

| | | | |
|---|---|---|---|
| CN | 101211486 | A | 7/2008 |
| CN | 101482992 | A | 7/2009 |
| CN | 201294012 | Y | 8/2009 |
| DE | 19649455 | A1 | 6/1997 |
| EP | 1717764 | A2 | 11/2006 |
| GB | 2 119 993 | A | 11/1983 |
| WO | 2008111148 | A1 | 9/2008 |

OTHER PUBLICATIONS

Supplementary European Search Report dated. Feb. 22, 2013 from corresponding European Application No. 10827853.

* cited by examiner

FINANCIAL SELF-HELP SERVICE DEVICE FOR PREVENTING PLUGGING BY FOREIGN OBJECTS AND DAMAGE BY MUCILAGE GLUE

The present application is a U.S. National Stage Patent Application of International Application No. PCT/CN2010/077195, filed on Sep. 21, 2010, which application claims the benefit of priority to Chinese patent application No. 200910193708.2, filed with the Chinese State Intellectual Property Office on Nov. 6, 2009. The entire disclosures thereof are incorporated herein by reference.

FIELD OF THE INVENTION

The present invention relates to a financial self-service apparatus, and more particular to a financial self-service apparatus which may prevent a cash inlet/outlet thereof from being damaged by inserted foreign matters and glue.

BACKGROUND OF THE INVENTION

At present, the financial self-service apparatus are widely used. Independent self-service apparatus may provide 24-hour uninterrupted service, so as to provide many advantages to people's lives. Unattended automatic teller machines are convenient to depositors. However, it also provides an opportunity for criminals to steal or intercept money from depositors. As the automatic teller machine is widely installed, criminal cases for the automatic teller machine are also increasing year after year. Such kind of crime mainly includes, i) illegally intercepting money from depositors by taking some actions to the cash outlet; and ii) stealing money from depositors by illegally obtaining information and passwords of bank cards of depositors.

For the first kind of crime, the financial self-service apparatus needs to be equipped with a cash outlet gate which may prevent foreign matters from being inserted, prevent liquid glues, resist a certain violent damage and avoid from being illegally opened. A current cash outlet gate is generally resisted by a gate stopper in order to prevent from being illegally opened. However, it is inevitable to form a gap between the gate and a base plate when assembling the gate, and thus criminals may move the gate stopper from the gap with a thin rigid sheet, so that the gate may be easily opened. Obviously, it is an important problem of designing the financial self-service apparatus to improve the safety and reliability of the cash outlet gate and prevent the cash outlet gate from being illegally opened.

Therefore, it is necessary to provide an anti-inserted foreign matter and anti-liquid glue damaged financial self-service apparatus, which has simplified structure, a low cost and high safety and reliability.

SUMMARY OF THE INVENTION

The object of the invention is to provide anti-inserted foreign matter and anti-liquid glue damaged financial self-service apparatus.

In view of the above object, the present invention provides a financial self-service apparatus having a panel which is provided with a cash inlet/outlet. The financial self-service apparatus further includes a gate configured to open or close the cash inlet/outlet. The edges of the gate engaged with the cash inlet/outlet are provided with polyoxymethylene (POM) plastic convex dots, so that a flow guiding gap is formed between the gate and the panel when the gate closes the cash inlet/outlet.

Preferably, the polyoxymethylene (POM) plastic convex dots are distributed uniformly and equidistantly.

More preferably, the polyoxymethylene (POM) plastic convex dots are sphere convex dots.

The self-locked gate device according to the present invention has the following advantages.

The present invention utilizes the characteristic that liquid glues available in the market don't stick the POM plastic. The edges of the gate engaged with the cash inlet/outlet of the financial self-service apparatus are provided with POM plastic convex dots, thus, the flow guiding gap for liquid glues is formed, and guides liquid glues to flow out. Besides, the convex dots are designed as sphere convex dots, which may minimize the contact area between the gate structure and the panel of the cash inlet/outlet of the financial self-service apparatus, and decrease the destructive degree of glues to the gate device, thereby preventing the financial self-service apparatus from being damaged by glues. In addition, POM plastic convex dots are uniformly distributed. Foreign matters larger than the gap between adjacent convex dots cannot be inserted into the financial self-service apparatus, thereby performing the function of preventing foreign matters from being inserted.

DETAILED DESCRIPTION

Figure 1:
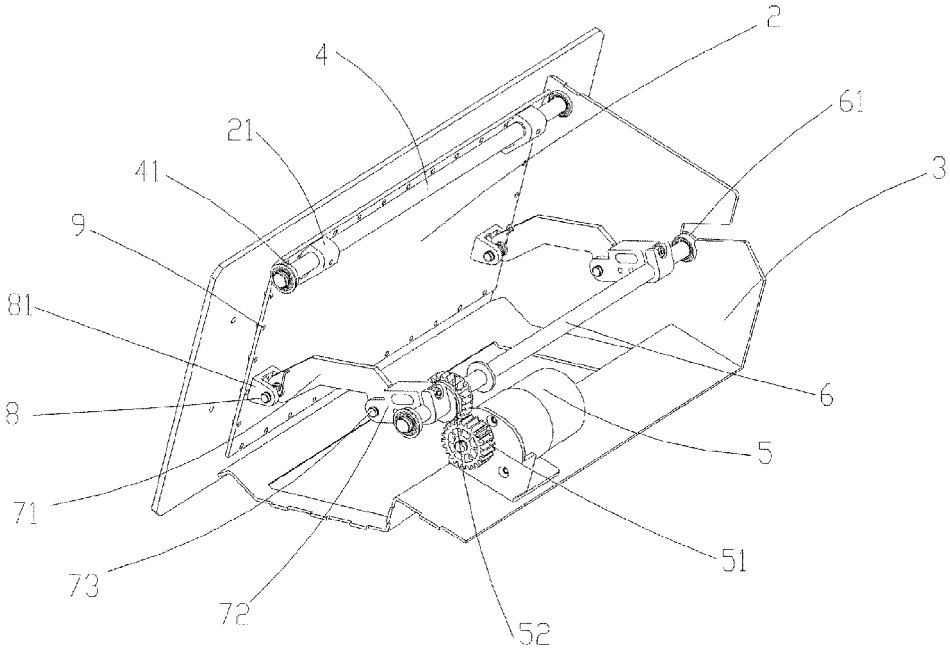
FIG. 1 is a schematic structural view of the gate part of the financial self-service apparatus according to a preferred embodiment of the present invention.

Hereinafter, the technical solutions in embodiments of the present invention will be described clearly and completely with reference to drawings of the embodiments of the present invention. It is apparent that the embodiments to be described are merely a portion of embodiments of the present invention, but not all of the embodiments. Based on the embodiments of the present invention, all of other embodiments made by those skilled in the art without inventive effort fall into the protection scope of the present invention.

Referring to FIGS. 1 to 6, the preferred gate device of the cash inlet/outlet 1 applied in the financial self-service apparatus includes an integral welded frame 3, a door 2 and a power transmission mechanism. The door 2 is of a plate shape. A plurality of polyoxymethylene (POM) plastic sphere convex dots 9 are provided at peripheral edges of the front surface of the door 2, wherein the front surface of the door 2 is engagable with a cash inlet/outlet of the financial self-service apparatus, and the peripheral edges of the door 2 are engagable with the peripheral edges of the cash inlet/outlet. The POM plastic sphere convex dots 9 are arranged and fixed at the peripheral edges of the door plate equidistantly. When the door 2 is in a closed state, the POM plastic anti-sticking sphere convex dots 9 are in contact with the panel of the financial self-service apparatus, and a flow guiding gap is formed between the door 2 and the panel, foreign matters which are larger than the distance between the POM plastic sphere convex dots 9 and the flow guiding gap between the door and the panel cannot be inserted. In addition, since commonly used liquid glues such as 502 and AA do not stick POM plastic and the POM plastic sphere convex dots are in contact with the panel of the financial self-service apparatus, the contact area between the door 2 and the panel of the financial self-service apparatus may be greatly reduced. Thus, referring to FIG. 3, when the liquid flows into the financial self-service apparatus through the gap between the panel of the financial self-service apparatus and the door 2, the liquid may flow through the space between the POM plastic sphere convex dots and the flow guiding gap between the door and the panel, and then flow out via a flow guiding inclined surface 31 (so do the dust and the water). Since remnant glue on the contact surface between the POM plastic anti-sticking sphere convex dots and the panel of the financial self-service apparatus doesn't stick the POM plastic, the door may be opened by a torque of the door opening electric motor which is slight larger than the normal torque. Therefore, the provision of the POM plastic sphere convex dots may effectively both prevent foreign matters or liquid from filling into the financial self-service apparatus through the gate device by criminals, and prevent the gate device from being damaged with the liquid glues available in the market by criminals, and thus play a safeguard function.

Figure 4:
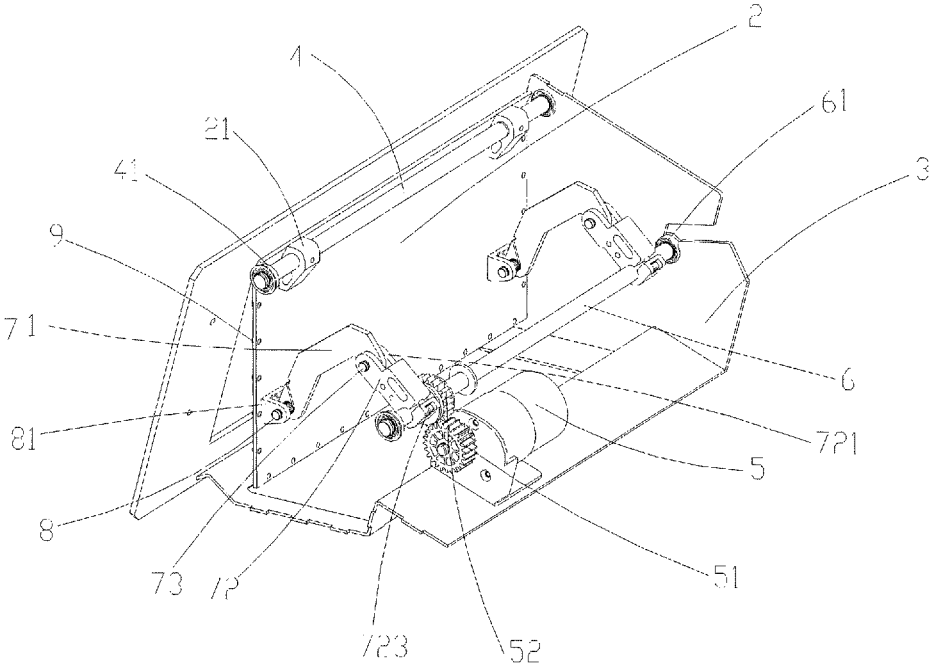
FIG. 4 is a schematic view of the gate device in FIG. 1 when being in the opening course.
Figure 5:
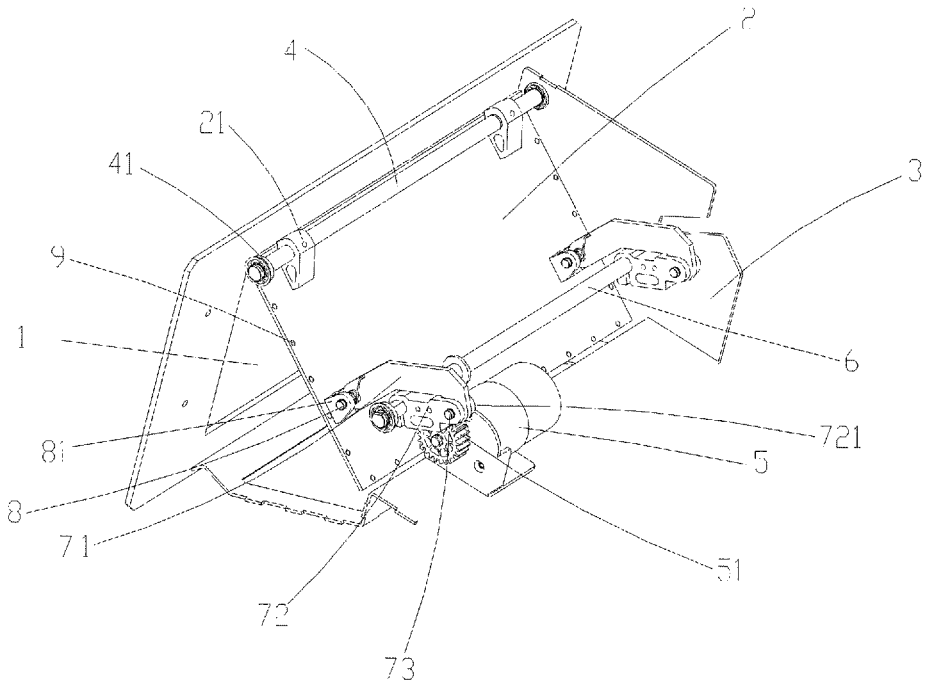
FIG. 5 is a schematic view of the gate in FIG. 1 when being in a completely opened state.
Figure 6:
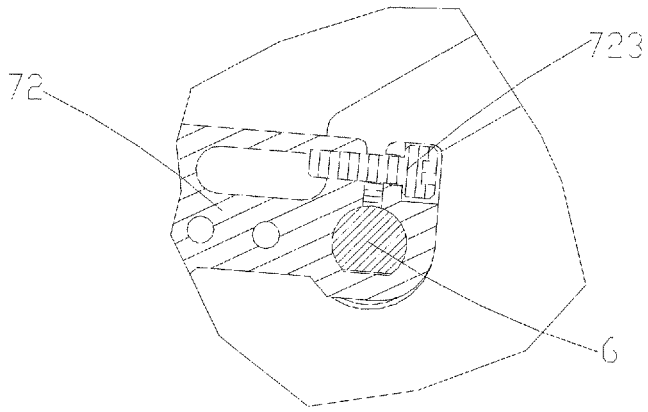
FIG. 6 is a schematic view of an adjustable rod embracing structure.

Referring to FIGS. 2, 4, 5 and 6, in order to meet the safe requirement of automatically opening the gate and preventing the gate from being illegally opened by an external force, one side of the door 2 is installed to the frame 3 through a first rotation shaft 4 and is rotatable around the first rotation shaft 4. Specifically, a pair of shaft seats 21 is fixed on the back surface of the door 2, and the first rotation shaft 4 is fixed to the door 2 through the shaft seats 21. Two ends of the first rotation shaft 4 are connected to the frame 3 through a pair of bearings 41. After being installed, the door 2 may be rotated around the axis of the first rotation shaft 4, so as to open or close the cash inlet/outlet 1 of the financial self-service apparatus. Certainly, the power to rotate the door 2 around the axis of the first rotation shaft 4 comes from the power transmission mechanism which is fixed on the frame 3. The power transmission mechanism includes a electric motor 5, a driving gear 51, a driven gear 52 and a pair of one-way folded connecting rod mechanism. Specifically, the electric motor 5 is fixed on the frame 3, and drives the driving gear 51 to rotate in a clockwise or a counterclockwise direction. The driven gear 52 is engaged with the driving gear 51, and is rotated in a reverse direction as the driving gear 51 rotates. The driven gear 52 is installed on a rotation shaft 6 which is installed on the frame 3 through a pair of bearings 61. The driven gear 52 is fixedly connected with the rotation shaft 6. When the driven gear 52 is rotated, the rotation shaft 6 is rotated synchronously. The pair of one-way folded connecting rod mechanisms are connected between the rotation shaft 6 and the door 2, and located symmetrically at two ends of the rotation shaft 6. Specifically, each of one-way folded connecting rod mechanisms includes a first connecting rod 71 and a second connecting rod 72. One end of the first connecting rod 71 is connected to the door 2 through a rotation shaft 8. The rotation shaft 8 is fixed on the back surface of the door 2 through shaft seats 81. The rotation shaft 8 is disposed to parallel to the first rotation shaft 4, and located at the other side of the back surface of the door 2 opposite to the rotation shaft 4. One end of the second connecting rod 72 is hinged with the other end of the first connecting rod 71 through a shaft 73. Specifically, the end of the second connecting rod 72 adjacent to the first connecting rod 71 is formed into two extending sheets 721. The rotation shaft 73 fixedly passes through the two extending sheets 721. The first connecting rod 71 is hold between the two extending sheets 721 and movably provided on the rotation shaft 73. The other end of the second connecting rod 72 is fixedly connected to the rotation shaft 6, and is rotated as the rotation shaft 6 rotates. As shown in FIG. 6, the second connecting rod 72 and the rotation shaft 6 are designed into a rod embracing structure. When assembling, the end of the second connecting rod 72 may clamp the rotation shaft 6 by adjusting a tightening screw 723. Such rod embracing design allows the second connecting rod 72 to be stably and fixedly connected to the rotation shaft 6 and be rotated as the rotation shaft 6 rotates, and may ensure that there is no slip between the second connecting rod 72 and the rotation shaft 6, thereby ensuring that two second connecting rods 72 of the pair of one-way folded connecting rod mechanisms 70 may be synchronously rotated as the rotation shaft 6 rotates. In this embodiment, when being rotated around the axis of the shaft 6, the two second connecting rods 72 may be effectively maintained in parallel, that is, they are not twisted.

When the electric motor 5 rotates in the counterclockwise direction as shown in FIG. 4, the driving gear 51 is rotated in the counterclockwise direction, and thus the driven gear 52 is rotated in the clockwise direction. Thus, the rotation shaft 6 and the second connecting rod 72 fixedly connected to the rotation shaft 6 are rotated in the clockwise direction. Since the second connecting rod 72 is hinged with the first connecting rod 71 through the shaft 73, the first connecting rod 71 is rotated when the second connecting rod 72 rotates in the clockwise direction. Specifically, the end of the first connecting rod 71 hinged with the second connecting rod 72 is raised, and thus the other end thereof connected to the rotation shaft 8 is raised, so as to draw the door 2 to rotate around the axis of the first rotation shaft 4, thereby opening the cash inlet/outlet 1 of the financial self-service apparatus. As shown in FIG. 5, a schematic view of the gate when being in the completely opened state is shown, at this moment, the first connecting rod 71 and the second connecting rod 72 are approximately in parallel, and the second connecting rod 72 cannot drive the first connecting rod 71 to rotate in the clockwise direction, that is, the first connecting rod 71 and the second connecting rod are in folded state.

Figure 2:
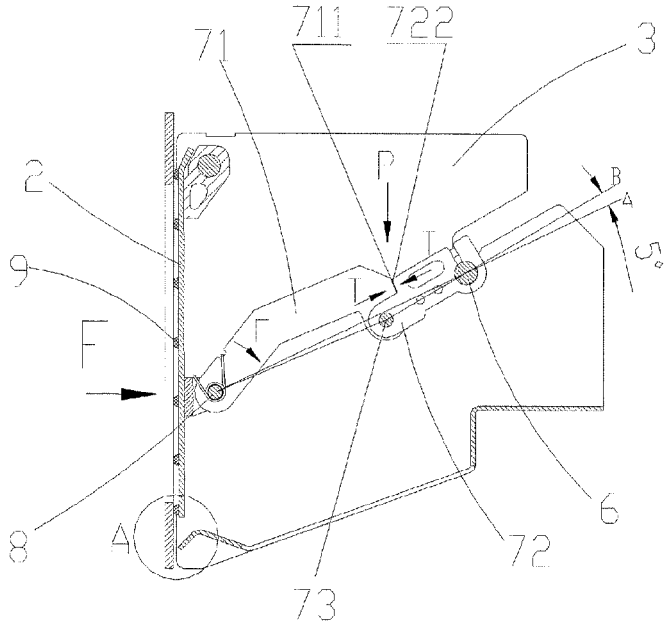
FIG. 2 is a schematic sectional view of the gate in FIG. 1 when being in the closed state.
Figure 3:
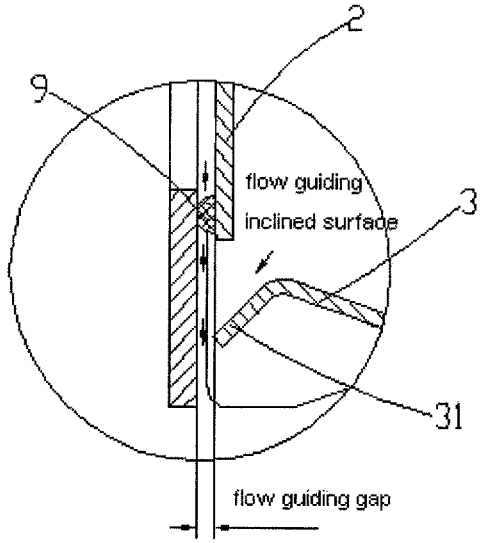
FIG. 3 is a partial enlarged schematic view of portion A in FIG. 2.

Correspondingly, when the door 2 is to be closed, the electric motor 5 rotates in reverse direction, and drives the driving gear 51 to rotate in the clockwise direction, so that the driven gear 52 is rotated in the counterclockwise direction. Thus, the rotation shaft 6 and the second connecting rod 72 are rotated in the counterclockwise direction. The second connecting rod 72 pushes the first connecting rod 71 to move, and the first connecting rod 71 pushes the door 2 to rotate around the axis of the first rotation shaft 4 in the clockwise direction, thereby closing the door 2. As shown in FIG. 2, a schematic sectional view of the gate when being in the completely closed state is shown, at this moment, the first connecting rod 71 and the second connecting rod 72 are in an approximate straight state. The end of the first connecting rod 71 adjacent to the shaft 73 has an end surface 711, and the second connecting rod 72 has an end surface 722 cooperated with the end surface 711 of the first connecting rod 71. At this moment, as shown in FIG. 4, the end surface 711 and the end surface 722 butt against with each other, so that the second connecting rod 72 cannot be continuously rotated in the counterclockwise direction, thereby the door 2 being in the closed state.

At this moment, if the door is pushed by an external force F, the external force F is transmitted to the second connecting rod 72 through the first connecting rod 71 in a direction of connecting line between the axes of the shaft 8 and the shaft 73. Since the axis of the shaft 73 is positioned below the connecting line between the axis of the shaft 8 and the axis of the shaft 6, the second connecting rod 72 would only be rotated around the axis of the shaft 6 in the counterclockwise direction, so that the first connecting rod 71 have to swing around the axis of the shaft 8 in the clockwise direction. However, the door has been in the closed state, and the end surface 711 of the end of the first connecting rod 71 adjacent to the shaft 73 and the end surface 722 of the end of the second connecting rod 72 adjacent to the shaft 73 have been butted against with each other, so the second connecting rod 72 cannot be rotated around the axis of the shaft 6 in the counterclockwise direction, and the first connecting rod 71 cannot swing around the axis of the shaft 8 in the clockwise direction, thereby achieving the self-locked state of the connecting rod mechanisms 70. Besides, when the external force F is increased, the interaction force between the end surface 711 of the first connecting rod 71 and the end surface 722 of the second connecting rod 72 is also increased, meanwhile, the shearing force exerted to the shaft 73 is also increased, which may effectively prevent the gate device from being illegally opened by the external force F.

As can be known from the above description, in order to prevent the gate device from being illegally opened by an external pushing force, it is necessary to ensure that, when being transmitted through the one-way folded connecting rod mechanism, the external force F cannot generate a component force, at the shaft 73, which may drive the connecting rod 72 to rotate around the shaft 6 in the clockwise direction. According to the principle of the mechanics transmission, in order to achieve the above object, there is a particular position relationship between the shaft 8, the connecting rod 71, the shaft 73, the connecting rod 72 and the shaft 6, i.e., the shaft 73 cannot be positioned above the connecting line A between the axis of the rotation shaft 8 and the axis of the rotation shaft 6. That is, the axes of the shaft 8, the shaft 73 and the shaft 6 should be in the same line, or the shaft 73 should be positioned below the connecting line A between the axes of the rotation shaft 8 and the rotation shaft 6. If a connecting line B is assumed between the axis of the shaft 73 and the axis of the rotation shaft 6, a separation angle is formed between the connecting line A and the connecting line B. Thus, since the end surfaces 711, 722 abut against with each other, the first connecting rod 71 cannot be rotated around the shaft 73 in the clockwise direction under the external force F, and thus the door 2 cannot be opened because the first connecting rod 71 cannot be rotated in the clockwise direction. If the door 2 is to be opened by rotating the first connecting rod 71 around the shaft 73 in the counterclockwise direction, the weight P of the connecting rod can be overcome only by the power of internal electric motor. That is, the shaft 6 is rotated and drives the second connecting rod 72 to rotate in the clockwise direction, so that the shaft 73 goes across the connecting line A between the shaft 8 and the shaft 6, and drives the connecting rod 71 to rotate, thereby opening the gate. In the embodiment, the separation angle between the connecting line A and the connecting line B is 5 degree. Of cause, the separation angle may be any appropriate degree according to an actual requirement.

In addition, in order to further prevent the gate device from being illegally opened, referring to FIGS. 1, 2, 4 and 5, a torsion spring 75 is provided on the rotation shaft 8. One end of the torsion spring 75 is fixed in a location groove 712 formed in an upper side surface of the first connecting rod 71, and the other end of the torsion spring 75 is fixed to the shaft seat 81 of the rotation shaft 8. The torsion spring 75 provides a force of rotating the first connecting rod 71 around the rotation shaft 8 in the clockwise direction, so that the first connecting rod 71 and the second connecting rod 72 are kept in the locked state when the door 2 is in the closed state. Therefore, the provision of the torsion spring 75 may effectively control the jump of the rotation shaft 73 of the connecting rods 71 and 72 in upward or downward direction caused by the vibrating force from the outer side of the door plate, and prevent self-lock of the one-way folded connecting rod mechanism 70 from failing caused when the jump of the rotation shaft 73 in upward or downward direction goes across the connecting line between the axis of the rotation shaft 74 and the axis of the rotation shaft 6. In other words, when a person attempts to apply the external force F to rotate the first connecting rod 71 in the counterclockwise direction and open the door 2, it is also necessary to overcome the torsion force of the torsion spring 75 to raise the shaft 73 such that the first connecting rod 71 is rotated in the counterclockwise direction. Therefore, due to the provision of the torsion spring 75, it becomes more impossible to illegally open the door 2 by attempting to rotate the first connecting rod 71 in the counterclockwise direction under the external force F.

Therefore, the gate device according to the present invention may be self-locked by the one-way folded connecting rod mechanism, and has a function of preventing the gate device from being violently and illegally opened. Besides, the one-way folded connecting rod mechanism has a simplified structure and a low cost.

In addition, the preferred embodiment according to the present invention may ideally solve some problems. For example, criminals take means such as filling foreign matters or liquid glues, so that the gate device works abnormally, in order to obtain an opportunity to destroy the gate device to steal the cash in the financial self-service apparatus.

While the preferred embodiments of the present invention have been described above, it is not intended to limit the protection scope of the present invention. Therefore, various equivalent variations made by those skilled in the art based on the contents described in the Description and illustrated in drawings of the present invention are deemed to fall into the protection scope of the present invention.

What is claimed is:

1. A self-service financial apparatus for preventing insertion of foreign matter and damage by glue, the self-service financial apparatus comprising:

a panel which is provided with a cash inlet/outlet; and a gate configured to open or close the cash inlet/outlet, wherein edges of the gate engaged with the cash inlet/outlet are provided with polyoxymethylene (POM) plastic convex dots so that a flow guiding gap is formed between the gate and the panel when the gate closes the cash inlet/outlet.

2. The self-service financial apparatus according to claim 1, wherein the polyoxymethylene (POM) plastic convex dots are distributed uniformly and equidistantly.

3. The self-service financial apparatus according to claim 1, wherein the polyoxymethylene (POM) plastic convex dots are sphere convex dots.

4. The self-service financial apparatus according to claim 2, wherein the polyoxymethylene (POM) plastic convex dots are sphere convex dots.

* * * * *